US007007666B2

(12) United States Patent
Kamimura et al.

(10) Patent No.: US 7,007,666 B2
(45) Date of Patent: Mar. 7, 2006

(54) ELECTRONICALLY CONTROLLED THROTTLE DEVICE

(75) Inventors: Yasuhiro Kamimura, Chiyoda-ku (JP); Kazuya Ishihara, Chiyoda-ku (JP)

(73) Assignee: Hitachi, Ltd., Tokyo (JP)

( * ) Notice: Subject to any disclaimer, the term of this patent is extended or adjusted under 35 U.S.C. 154(b) by 45 days.

(21) Appl. No.: 10/991,862

(22) Filed: Nov. 19, 2004

(65) Prior Publication Data

US 2005/0109315 A1 May 26, 2005

(30) Foreign Application Priority Data

Nov. 20, 2003 (JP) ..... 2003-390259

(51) Int. Cl.
*F02D 9/08* (2006.01)

(52) U.S. Cl. ..... 123/399; 123/337; 123/361

(58) Field of Classification Search ..... 123/361, 123/399, 337; 251/305
See application file for complete search history.

(56) References Cited

U.S. PATENT DOCUMENTS 6,407,543 B1 * 6/2002 Hagio et al. ..... 324/207.25
6,591,809 B1 * 7/2003 Saito et al. ..... 123/399
6,725,833 B1 * 4/2004 Irihune et al. ..... 123/399
6,819,102 B1 * 11/2004 Hagio et al. ..... 324/207.25
6,854,443 B1 * 2/2005 Keefover et al. ..... 123/337

FOREIGN PATENT DOCUMENTS

WO WO00/58614 10/2000

* cited by examiner

*Primary Examiner*—Hai Huynh
(74) *Attorney, Agent, or Firm*—Crowell & Moring LLP

(57) ABSTRACT

A cover mounted on a throttle body is provided with an intermediate connector to be connected to a motor terminal and an electronic control module. Inductances installed on the inner surface of the cover are connected to the DC motor and motor drive terminals of the electronic control module, through the intermediate connector.

25 Claims, 15 Drawing Sheets

ELECTRONICALLY CONTROLLED THROTTLE DEVICE

CLAIM OF PRIORITY

The present application claims priority from Japanese application serial no. 2003-390259, filed on Nov. 20, 2003), the content of which is hereby incorporated by reference into this application.

BACKGROUND OF THE INVENTION

The present invention relates to an electronically controlled throttle device, which electrically controls intake air flow into an in-vehicle engine.

Generally, the internal combustion engines for vehicles employ an electronically controlled throttle device which adjusts intake air flow by controlling a throttle valve opening by an actuator such as DC motor. The electronically controlled throttle device moves a position of the throttle valve by the actuator so as to be reach to a target opening which is calculated by an amount of accelerator pedal depression and operating status of the engine. The throttle valve opening is detected by a valve position sensor, and then a feed back control carries out.

The electronically controlled throttle device has a housing member (housing section) for the throttle valve and a housing member (housing section) for the valve drive motor, which are integrally molded, and a DC motor is put in the motor housing member. Furthermore, the throttle body is provided with a power transmission unit which transmits a driving power from the DC motor to the throttle valve, and a cover is mounted on the throttle body to protect the DC motor and the power transmission unit.

The DC motor is controlled by pulse signals from an H-bridge circuit, which is obtained by arranging switching elements in H-shape. A control amount according to a deviation between an actual opening and the target opening of the throttle valve is subjected to PID compensation calculation, converting the amount into a duty ratio, which is a ratio between ON time and OFF time, and then the ON/OFF control is carried out on the switching elements constituting the H-bridge circuit, by throttle device signals (throttle device-width modulation signals: PWM signals).

There are types of electronically controlled throttle body, i.e., in one type, an electronic control module for carrying out ON/OFF driving of the DC motor according to an opening deviation is installed on the throttle body cover, and in another type, the electronically control module is installed on an external engine control unit. The former is described, for example, in the following Patent Document 1.

[Patent Document 1] PUBLISHED JAPANESE TRANSLATION OF PCT INTERNATIONAL PUBLICATION FOR PATENT APPLICATION NO. WO 00/58614

In the meantime, when the DC motor is controlled by the pulse signals, a radiant noise may occur on startup of the switching operation and at the falling edge thereof. The radiation noise may cause a radio noise and the like. A general countermeasure against the radiant noise is based on a slew rate control, which carries out a control to make the startup slope and falling slope less steep. However, it is difficult to completely remove a noise which is generated from the DC motor itself of the electronic controlled throttle body, and a noise radiated from a wire harness (signal line) which connects the electronic controlled throttle body and the control unit. Therefore, those noises are radiated in FM radio frequency band and the like, thereby making a sound from the radio unclear.

In order to solve the problem above, an inductance is mounted between motor terminals for electrically connecting a brush of the DC motor and an external area, that is, inside the DC motor. The inductance is mounted not only to make down a slope of a large amount of current which flows in a moment, at startup and braking, but also to remove a noise. It is to be noted here that the inductance is set to be a value to the extent of not affecting a performance in response.

In the conventional art, the inductance is mounted inside the DC motor. However, a dimension of the inductance is determined based on a regulation by a coil diameter, according to a permissible current value specification and the maximum current specification at the time of using the electronic controlled throttle body. Particularly, in recent years, PWM signal frequency becomes higher, a noise level being increased, and thus a capacity of the inductance has to be enlarged. For this reason, the DC motor cannot be downsized, and further there is a problem of high-cost because environmental temperature specification of the inductance is made stricter due to self-heating of the DC motor. In addition, there is a practical problem that due to the heat of the DC motor, performance of field magnet (permanent magnet) is deteriorated, thereby reducing reliability.

SUMMARY OF THE INVENTION

An object of the present invention is to provide an electronically controlled throttle device, in which the DC motor can be downsized and made less expensive, as well as enhancing reliability and reducing the radiant noise.

The subject matter of the present invention is as follows.

A throttle body is configured with a throttle valve housing section and a motor housing section which are integrally molded. A DC motor is put in the motor housing section of the throttle body to drive the throttle valve. A power transmission unit is arranged on the throttle body to transmit a driving power from the DC motor to the throttle valve. A cover is attached on the throttle body to protect the DC motor and the power transmission unit. An inductance(s) is (are) installed on an inner surface of the cover and connected with the DC motor and a power supply through conductors.

Specifically, each one end of the conductors varied in the cover is allowed to protrude neat to the inductance on the inner surface of the cover. Such protruding ends of the conductors function as holder to hold both ends of the inductance.

The present invention is provided with the inductance, which is to remove a radiant noise, on the inner surface of the cover attached on the throttle body. Thus the DC motor as throttle drive motor can be downsized and made less expensive, as well as there is no more influence due to the heat of the DC motor, it is possible to enhance reliability and to reduce the radiant noise.

DETAILED DESCRIPTION OF THE INVENTION

A throttle body is configured with an external wall section for a gear space, a throttle valve housing section and a motor housing section which are integrally molded with an insulating material. A DC motor is put in the motor housing section of the throttle body. A power transmission unit is configured with gears which are arranged on the external wall section of the throttle body, and transmits a driving power from the DC motor to the throttle valve. A cover is attached on the external wall section, so it covers the DC motor and the power transmission unit. A connector, which is electrically connected with an external unit, is provided on an outer surface of the cover. The connector has a plurality of terminals including two power supply terminals for the DC motor. An electronic control module is placed in a module housing section provided at the cover to control said throttle valve. The electronic control module has two motor driving terminals, and is connected to the power supply terminal of the connector through an conductor buried in the cover. The electronic control module controls an opening degree of the throttle valve by driving the DC motor by electrical throttle devices. On the inner surface of the cover, an intermediate connector with joint members is provided, which has two terminals. The intermediate connector is connected to terminals of DC motor side through the joint member when the cover is attached on the external wall section of the throttle body. Two inductances constituting a noise eliminator are placed in parallel near to the module housing section on inner surface of the cover. One end of each inductance is connected with each motor driving terminal of the electronic control module through one conductor buried in the cover. Another end of each inductance is connected with each terminal of the intermediate connector through another conductor buried in the cover. Each one end of the conductors protrudes near to the inductances on the inner surface of the cover. Such protruding ends of the conductors hold both ends of the inductances. The inductances are covered by gel.

EXAMPLE 1

In FIG. 1 to FIG. 14, one embodiment of the present invention is shown. The first embodiment shows an example in which the electronic control module is installed on the cover.

Figure 1:
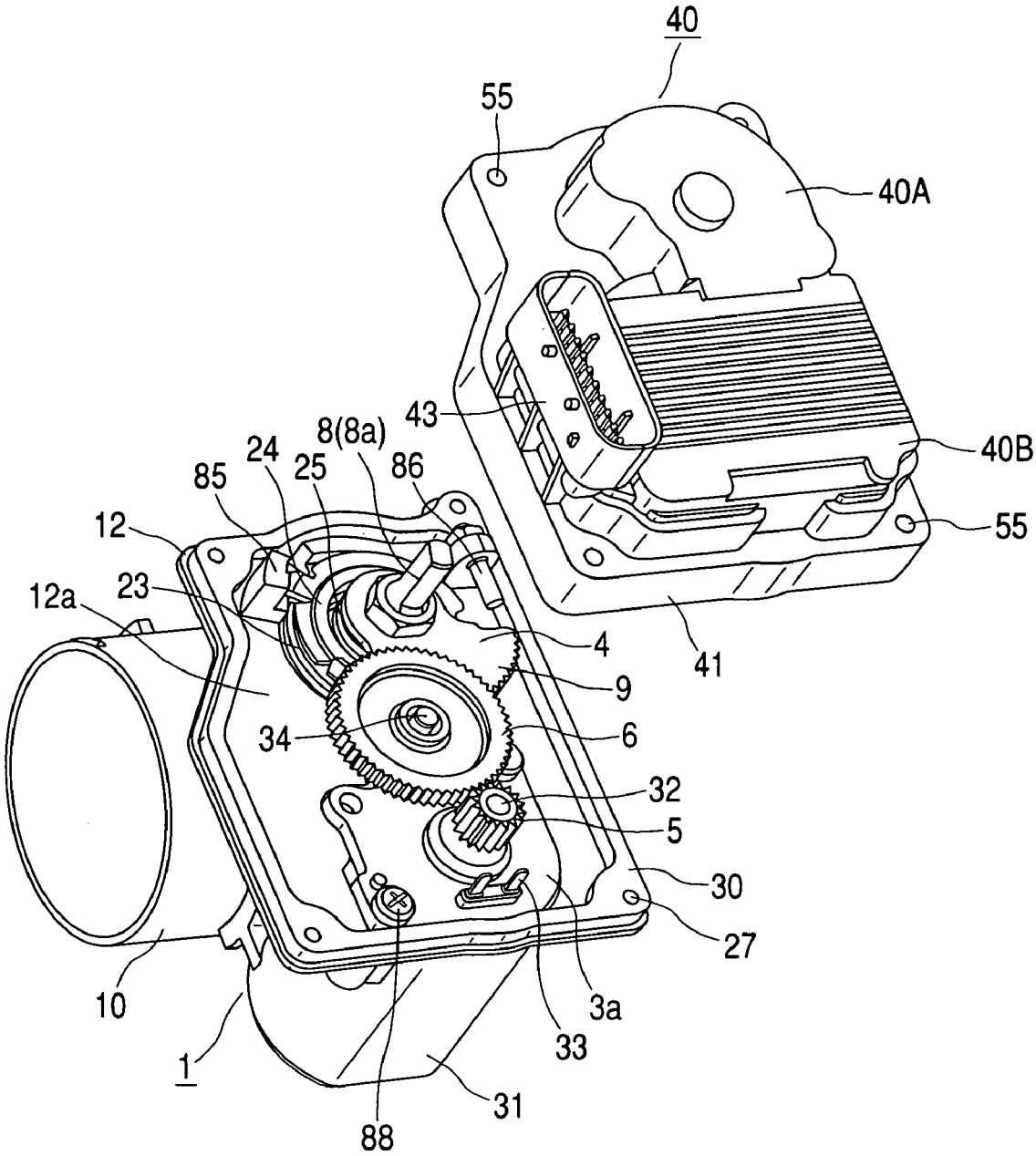
FIG. 1 is a perspective view showing the throttle device, when the cover is removed therefrom.
Figure 2:
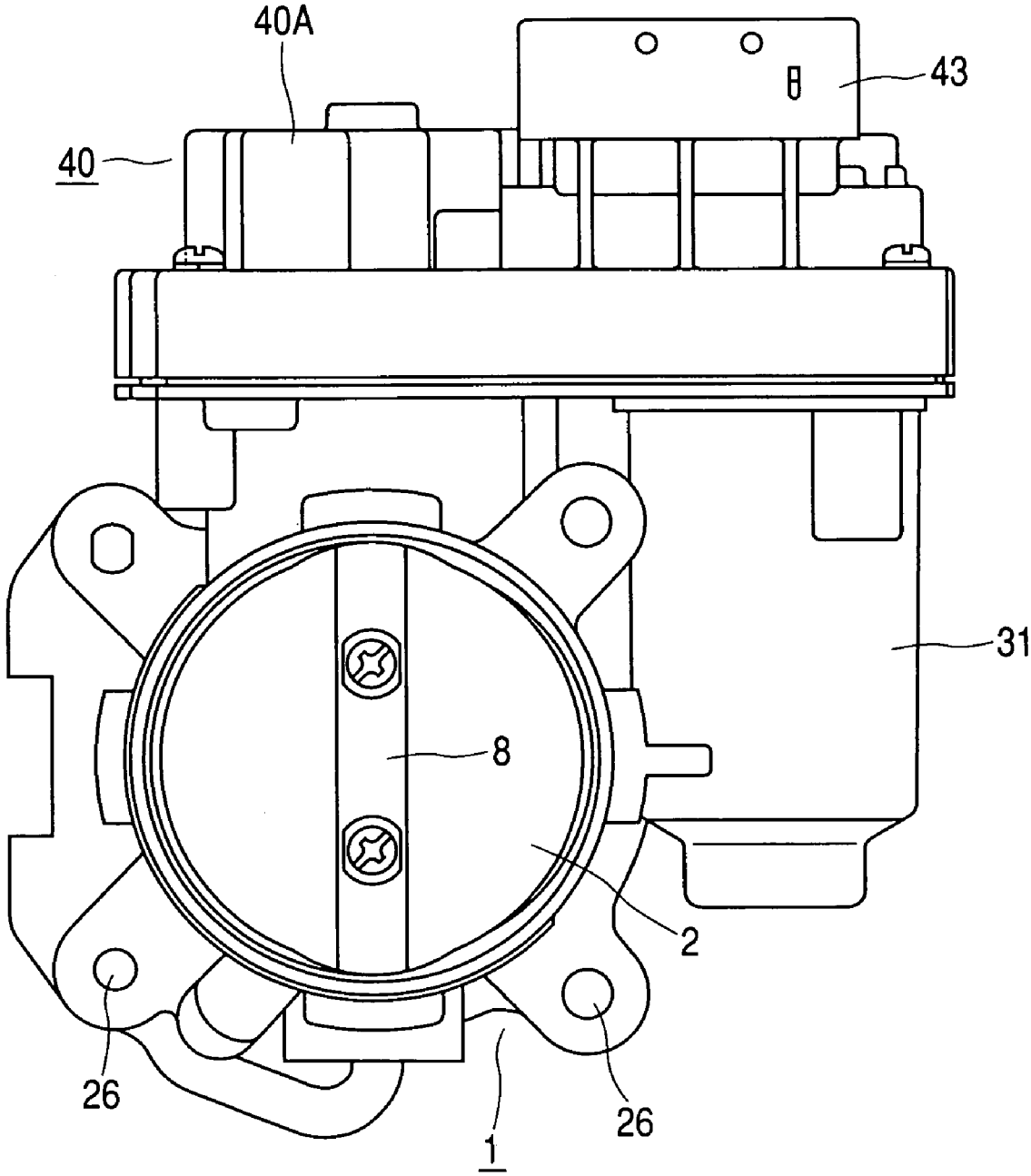
FIG. 2 is a front view showing the throttle device.
Figure 3:
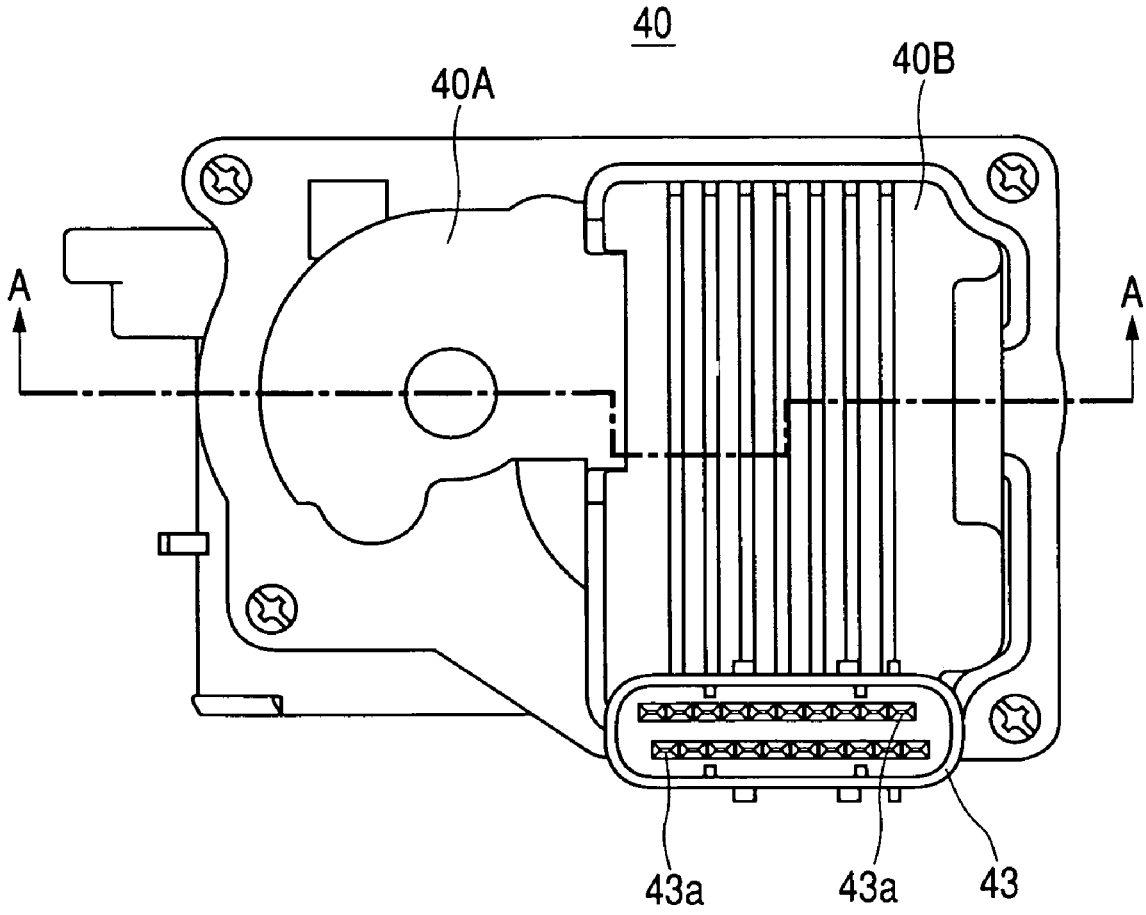
FIG. 3 is a plan view showing the throttle device.
Figure 4:
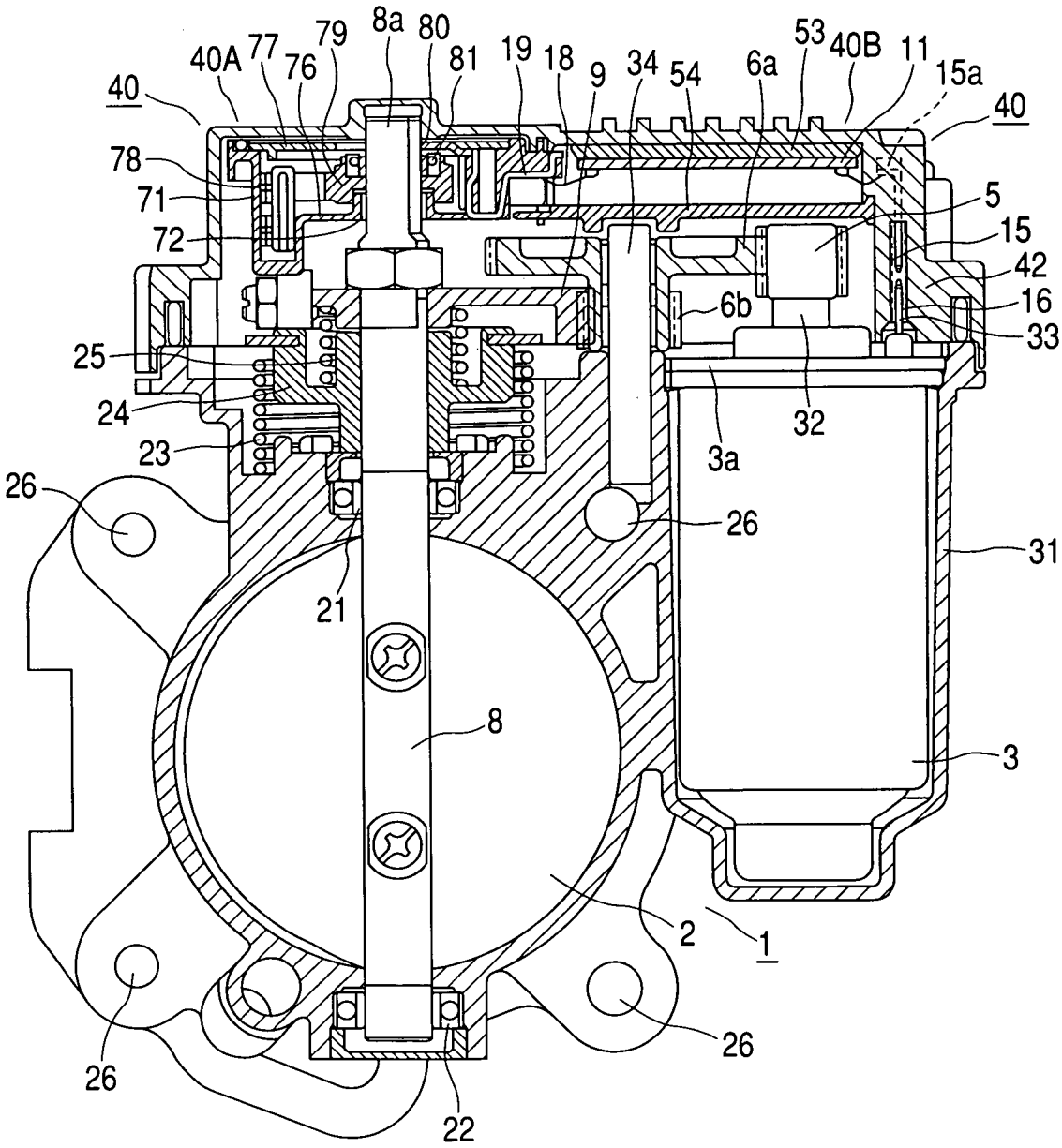
FIG. 4 is a cross sectional view taken along line A—A of FIG. 3.
Figure 5:
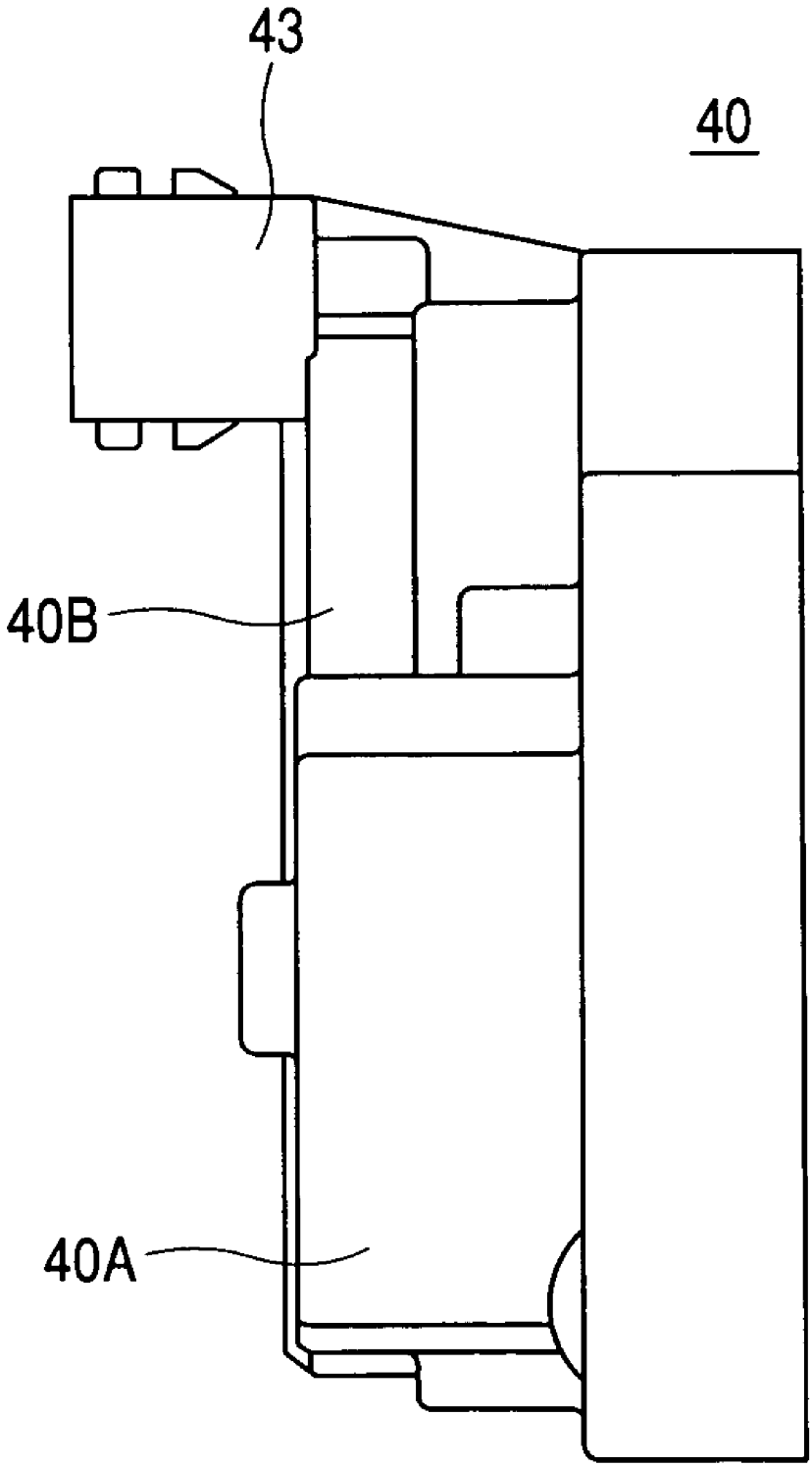
FIG. 5 is a side view showing the cover.
Figure 6:
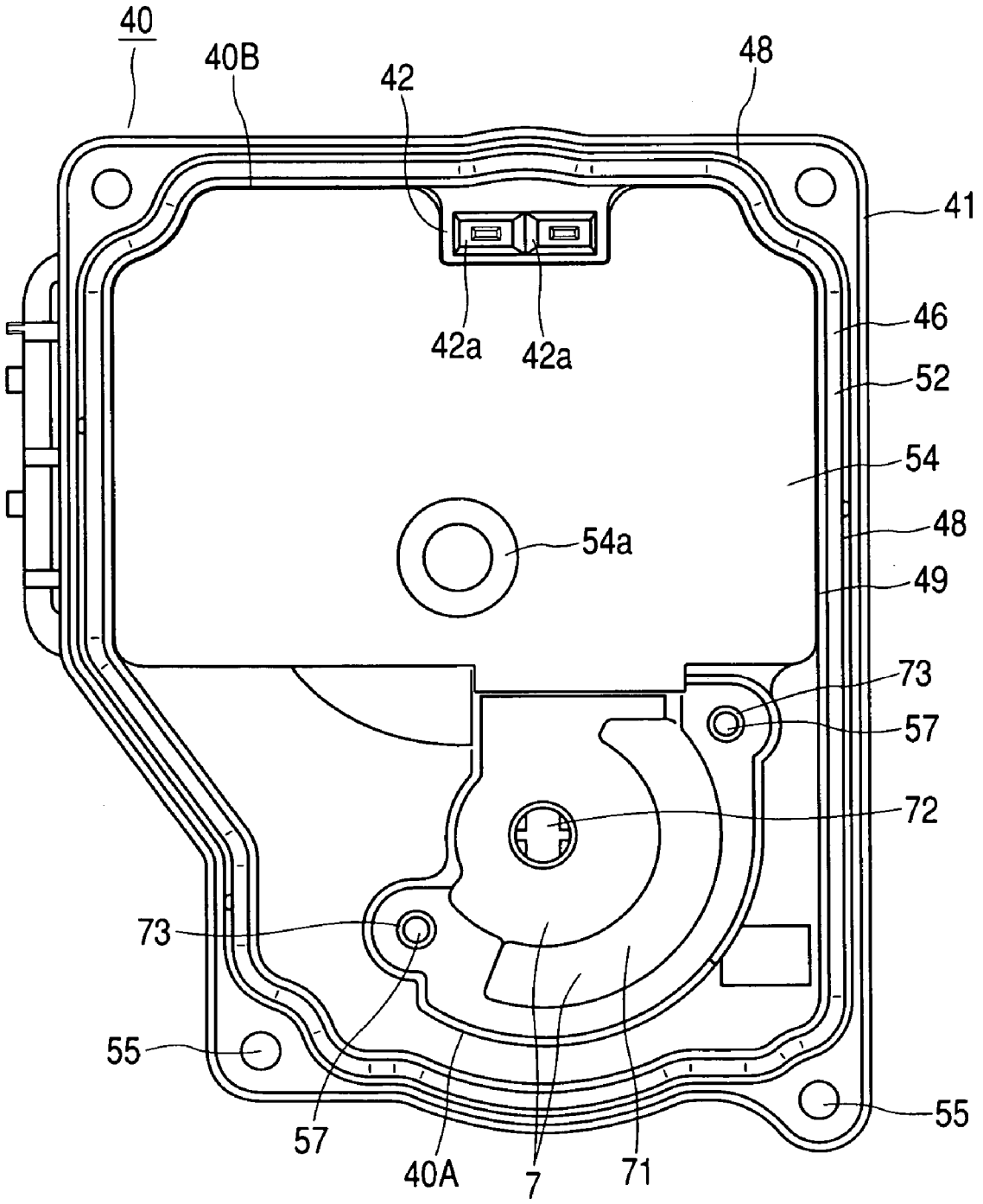
FIG. 6 is a bottom view showing the cover.
Figure 7:
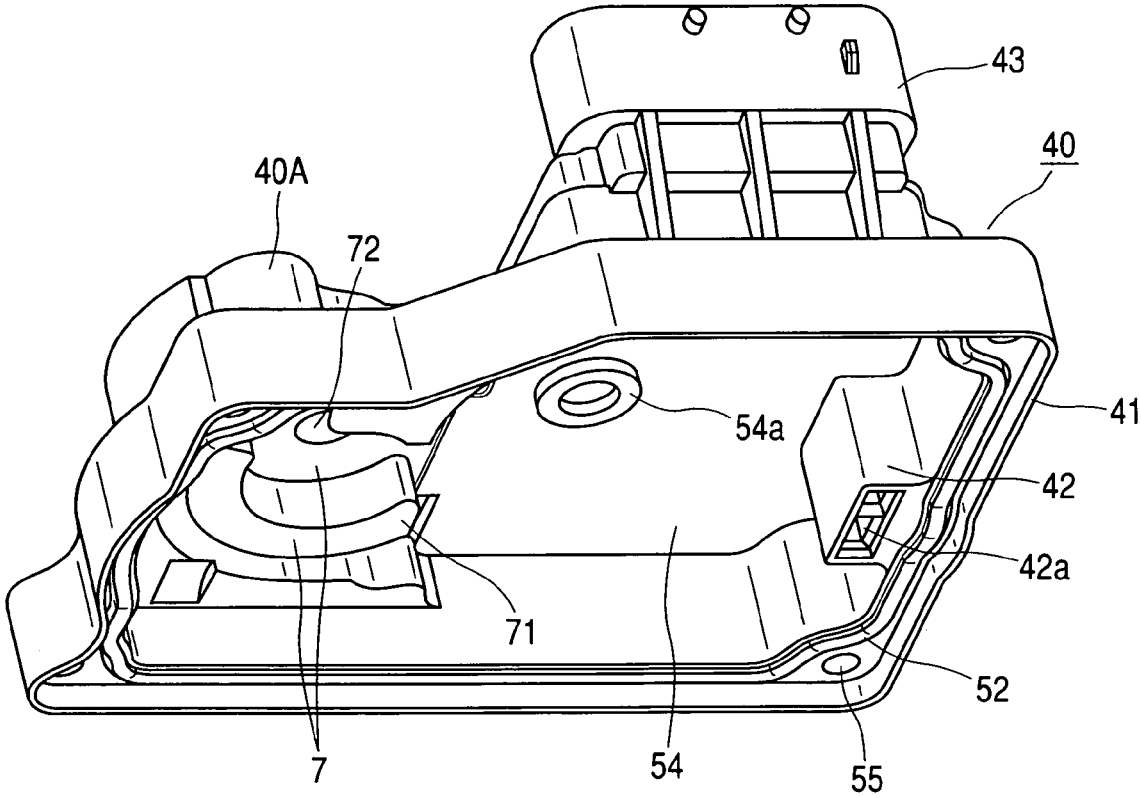
FIG. 7 is a perspective view, viewed from the bottom of the cover.
Figure 8:
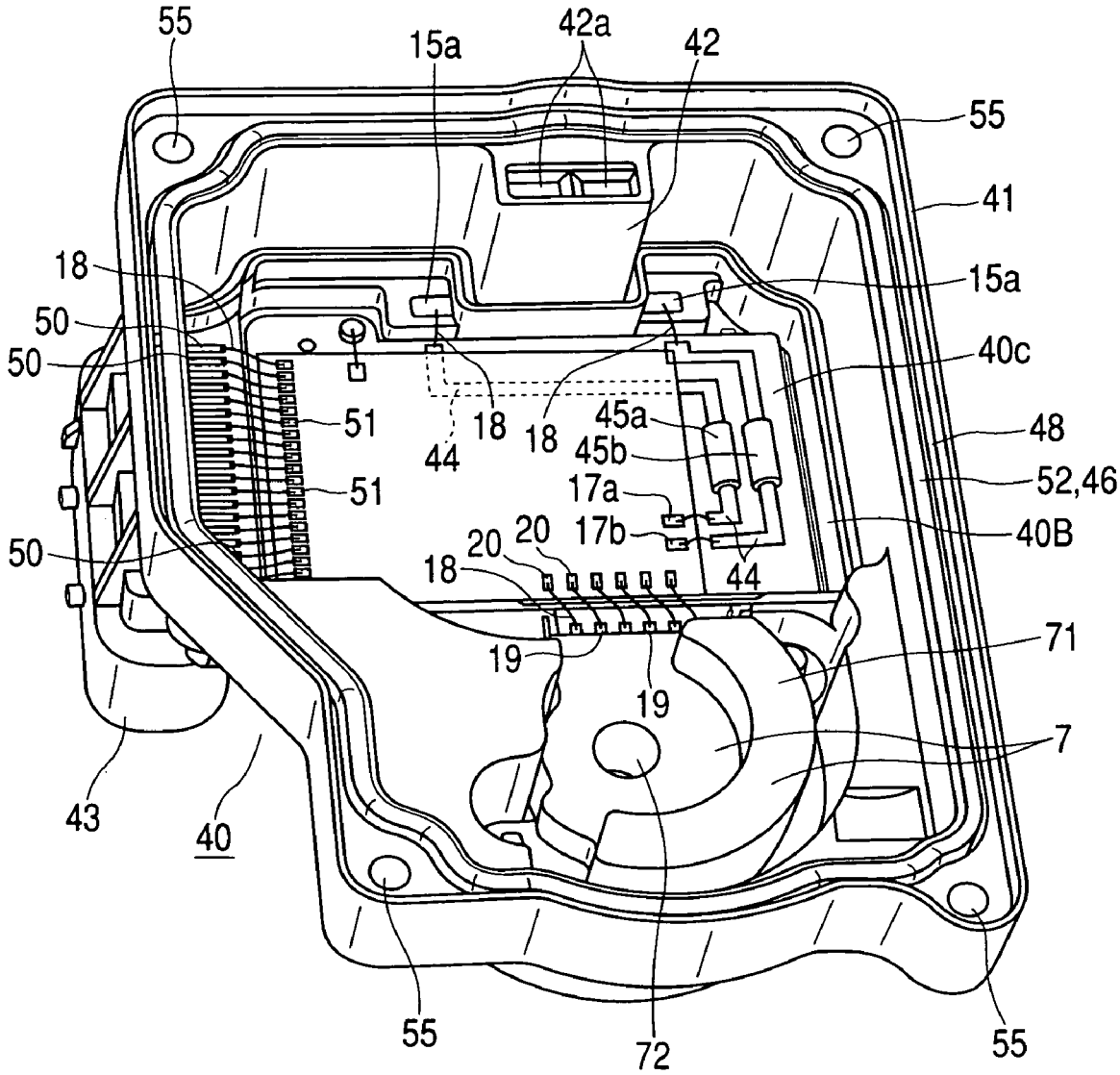
FIG. 8 is a perspective view, viewed from the bottom, in a state that the module cover is removed from the cover.
Figure 9:
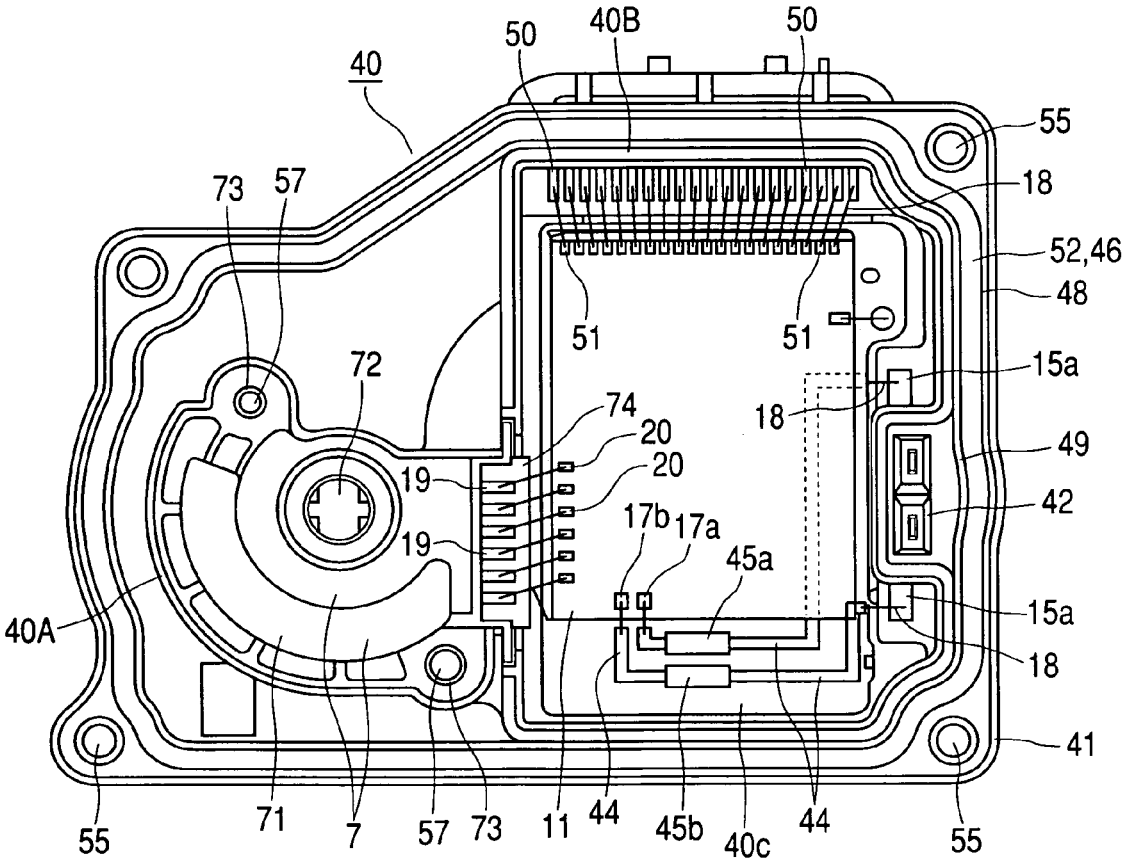
FIG. 9 is a bottom view in a state that the module cover is removed.
Figure 10:
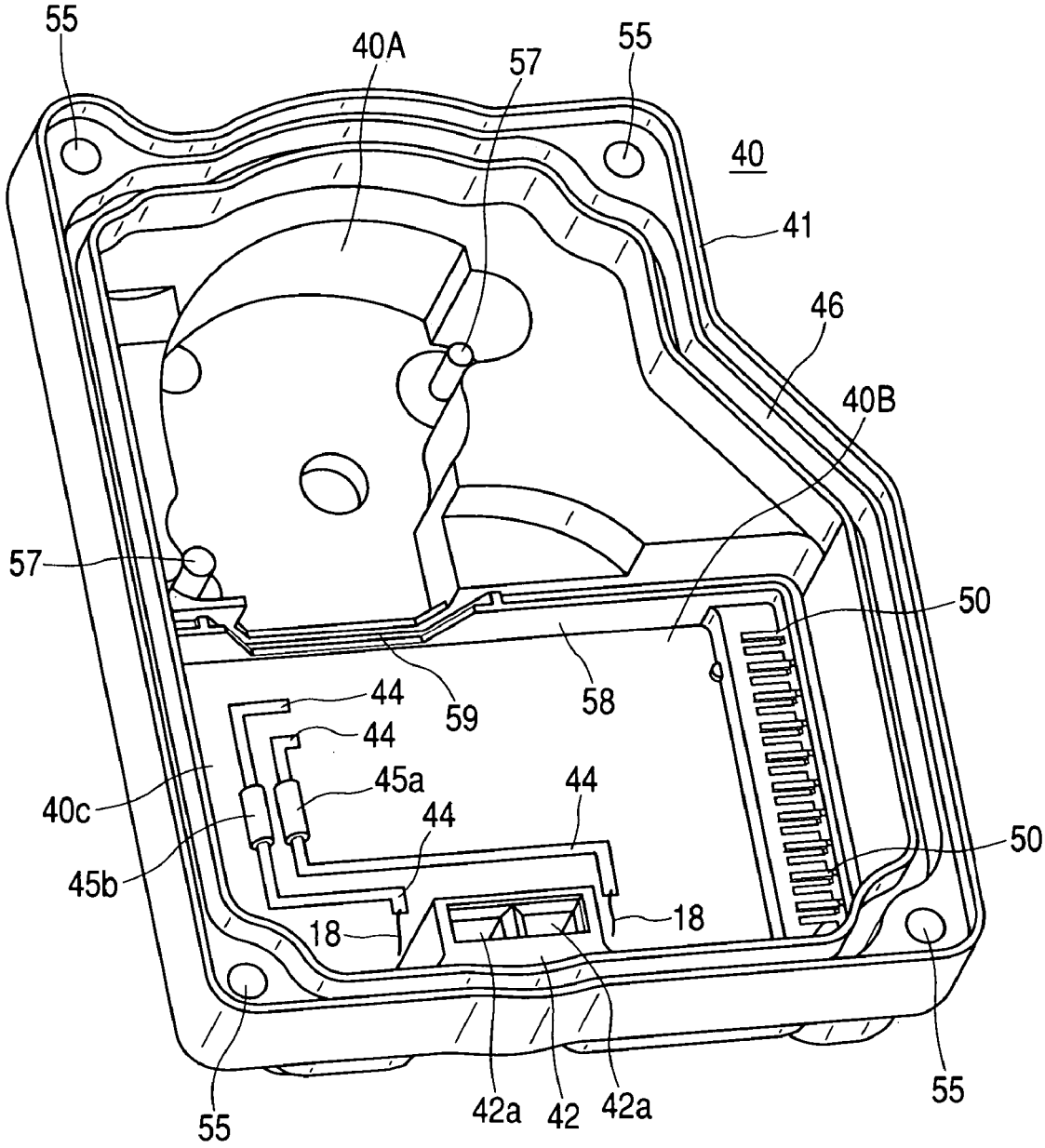
FIG. 10 is a perspective view in a state that the valve position sensor and the electronic control module are removed from the cover.
Figure 11:
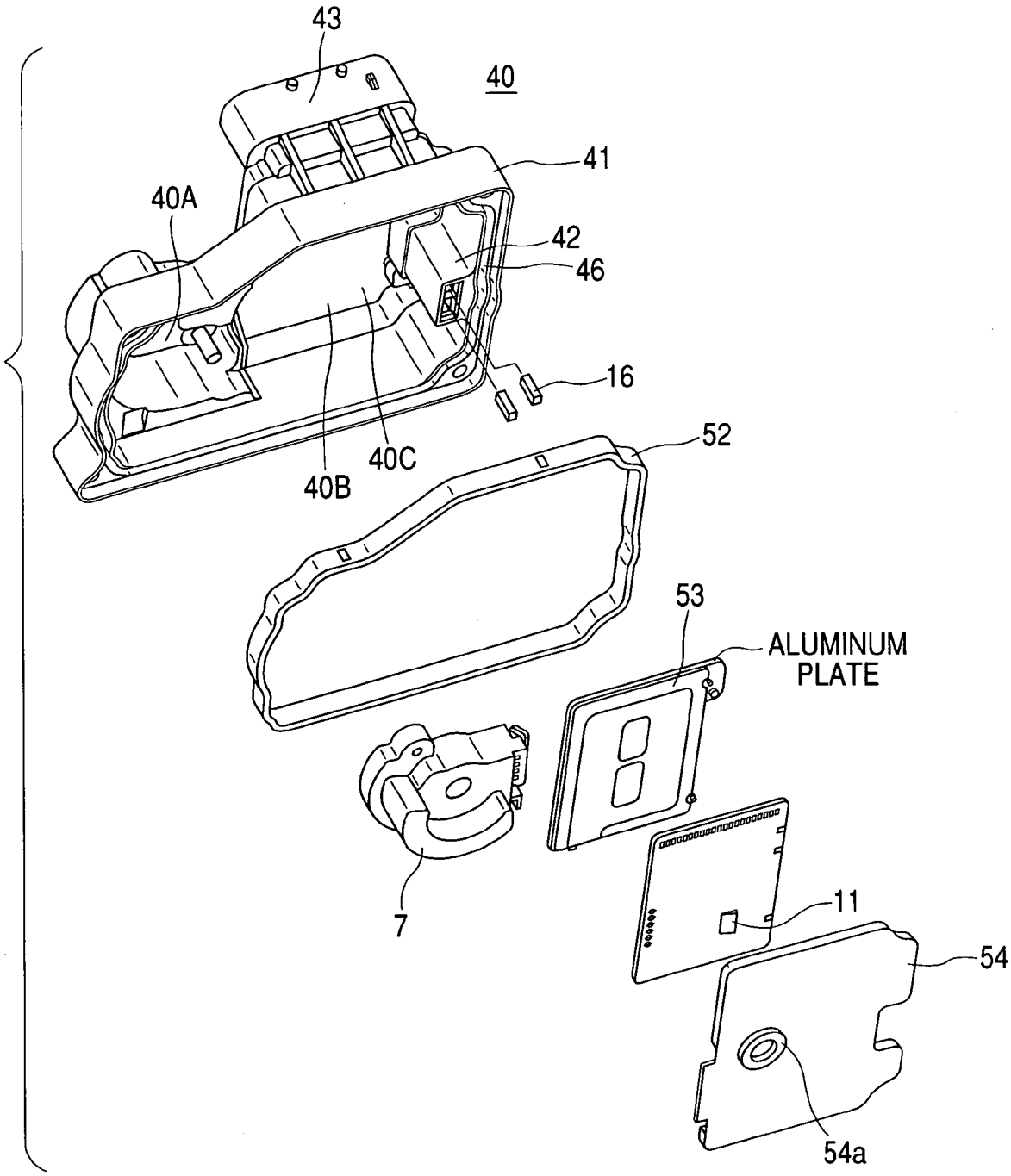
FIG. 11 is an exploded perspective view showing the cover and the components to be installed on the cover.
Figure 12:
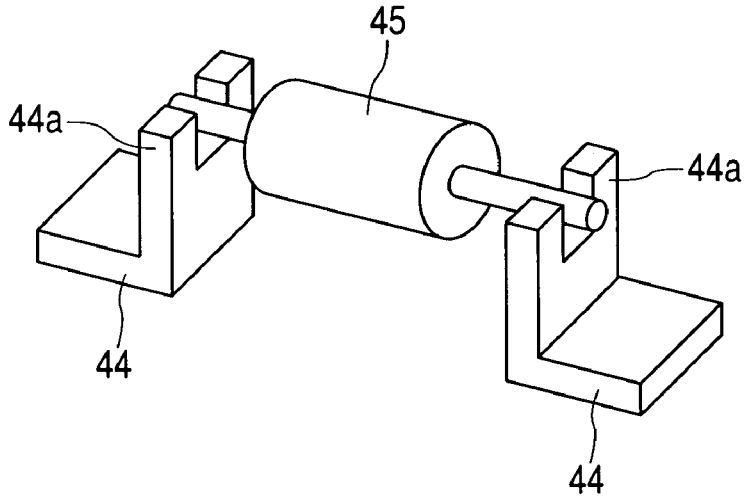
FIG. 12 is a supporting status view as one example of supporting the inductance.
Figure 13:
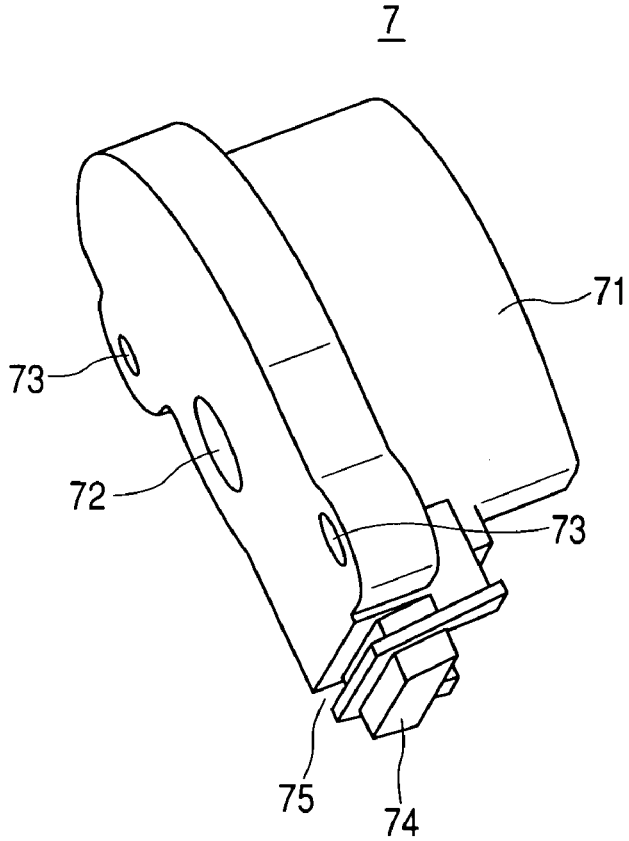
FIG. 13 is a perspective view showing the valve position sensor.
Figure 14:
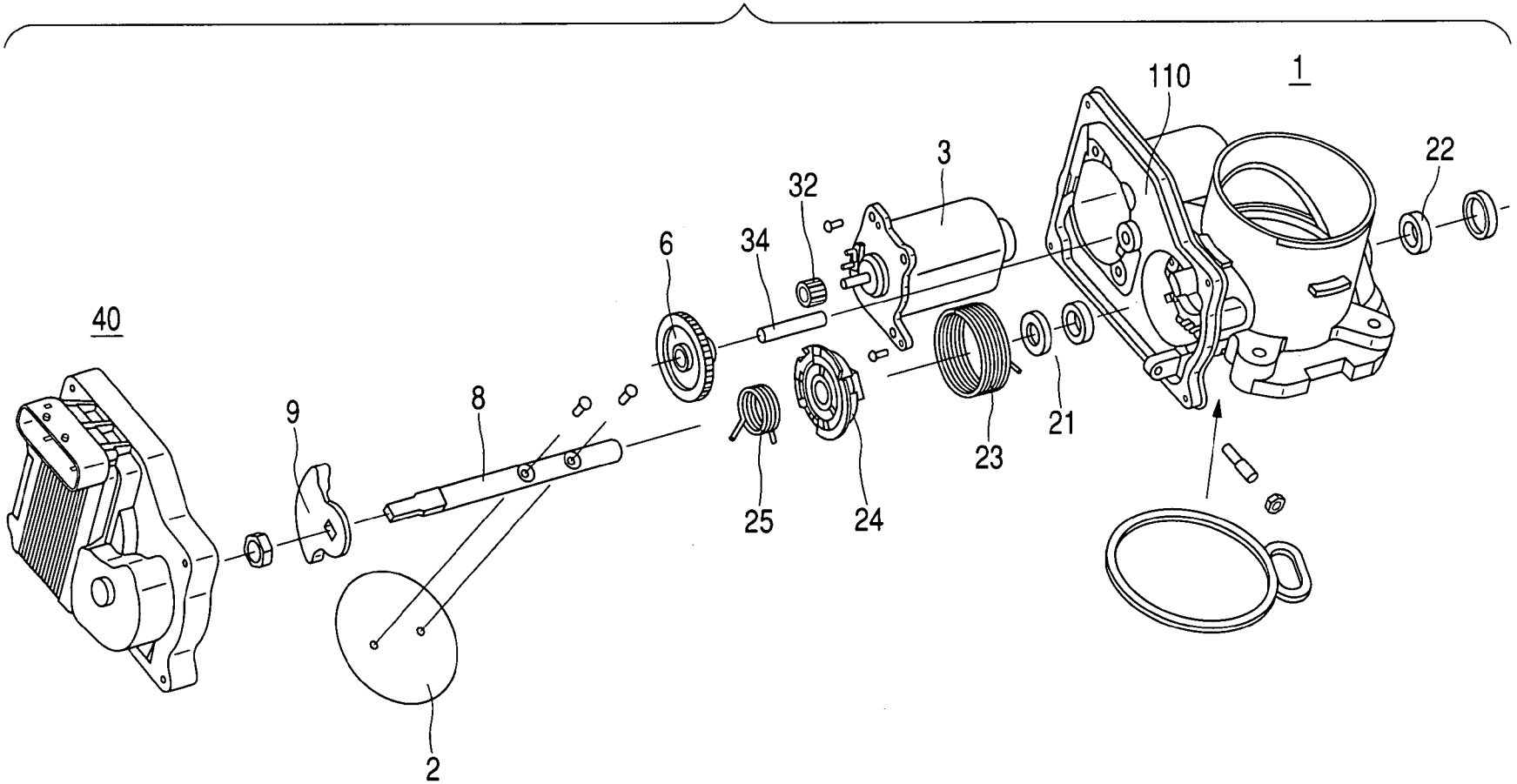
FIG. 14 is an exploded perspective view showing the electronically controlled throttle device.

FIG. 1 is a perspective view showing the throttle body, when the cover is removed therefrom. FIG. 2 is a front view showing the throttle device. FIG. 3 is a plan view showing the throttle device. FIG. 4 is a cross sectional view taken along line A—A of FIG. 3. FIG. 5 is a side view showing the cover. FIG. 6 is a bottom view showing the cover. FIG. 7 is a perspective view, viewed from the bottom of the cover. FIG. 8 is a perspective view, viewed from the bottom, in a state that the module cover is removed from the cover. FIG. 9 is a bottom view in a state that the module cover is removed. FIG. 10 is a perspective view in a state that the valve position sensor and the electronic control module are removed from the cover. FIG. 11 is an exploded perspective view showing the cover and the components to be installed on the cover. FIG. 12 is a holding status view as one example of holding the inductance. FIG. 13 is a perspective view showing the valve position sensor. FIG. 14 is an exploded perspective view showing the electronically controlled throttle device.

In FIG. 1 to 14, the electronically controlled throttle device comprises as main constitutional elements, as shown in FIG. 11 and FIG. 14, a throttle body (in some cases hereinafter, it may be simply referred to as "body") 1, a throttle valve 2, a DC motor 3 for driving the throttle valve 2 (a throttle valve driving unit; electric actuator), a power transmission unit 4, a valve position sensor (throttle position sensor) 7 which is provided on a throttle valve shaft 8 and measures a valve position (valve opening) of the throttle valve 2, a cover 40 for protecting the throttle valve 2, motor 3, and power transmission unit 4, and an electronic control module 11.

In the throttle body 1, as shown in FIG. 1, FIG. 2, and FIG. 4, is configured with an external wall section 12 for a gear space, a throttle valve housing section 10 and a motor housing section 31 which are integrally molded with an insulating material. The throttle valve housing section 10 is constituted by a cylindrical member having an air passage. A motor housing section 31 is used for a housing member for the DC motor 3. The throttle valve housing section 10 and the motor housing section 31 are arranged below the external wall section (external wall member) 12 for the gear space. The external wall section 12 for the gear space is formed in substantially rectangular shape on its plan view, and one edge is notched in "dogleg shape". On the upper surface 12*a* of the external wall section 12, there is formed a rim 30 all over the periphery thereof. Therefore, the upper surface 12*a* of the external wall section 12 is formed in a recessed shape.

As shown in FIG. 4, the throttle valve 2 fixed at the valve shaft 8 is rotatably put in the cylindrical member (throttle valve housing section) 10 forming the air passage of the body 1. The valve shaft 8 is held with bearings 21, 22 provided in the body 1. One end (upper end) 8*a* of the valve shaft 8 in the upper side of the Figure protrudes upwardly from the body 1 (external wall section 12). The protruding part 8*a* of the valve shaft 8 is equipped with a spring 23, a lever 24 and a spring 25. The spring 23, the lever 24, and the spring 25 are formed as shown in FIG. 14, and constitutes a default opening setting mechanism as described below.

As shown in FIG. 2 and FIG. 4, four holes 26 for installation of the throttle device are drilled in the body 1.

The DC motor 3 is put in the motor housing section 31 of the body 1. Axial direction of the motor shaft 32 of the DC motor 3 is same with that of the valve shaft 8. The motor shaft 32 protrudes upwardly from the upper surface 12*a* of the external wall section 12, and on this protruding part, a gear 5 is fixed.

In the body 1, as shown in FIG. 1 and FIG. 4, a gear shaft 34 is provided between the valve shaft 8 and the motor shaft 32 in the same direction as the axial direction of the valve shaft 8. The gear shaft 34 protrudes upwardly from the upper surface 12*a* of the external wall section (gear space section) 12, and a gear 6*a* is rotatably provided on the protruding part. On the gear shaft 34, a gear 6*b* is provided at lower position than the gear 6*a*, the gear 6*b* having a diameter smaller than the gear 6*a*. The gear 6*a* and the gear 6*b* are integrally molded, putting rotatably on the gear shaft 34. A fan-like gear 9 fixed on the valve shaft 8 is positioned so that it engages with the gear 6*b* on the lower side of the gear shaft 34. The fan-like gear 9 is fixed on the valve shaft 8 on the upper side of the lever 24. Engagements between the gear 5 and gear 6*a*, and between the gear 6*b* and the gear 9 constitute the power transmission unit 4. Driving power from the DC motor 3 is decelerated by the power transmission unit (deceleration gear mechanism) 4, thereby operating for opening and/or closing the throttle valve 2.

As thus described, the power transmission unit 4 for transmitting the driving power from the DC motor 3 to the throttle valve 2, the DC motor serving as a throttle valve driving unit, is integrally built in the body 1.

A cover 40 for protecting the throttle valve 2, the DC motor 3, and the power transmission unit (gear mechanism) 4 is molded with an insulating material such as resin. As shown in FIG. 10, a module housing 40B to install the electronic control module 11 for opening/closing control of the throttle valve 2 is integrally molded on the cover 40. In addition, a sensor housing 40A for taking in the valve position sensor 7 installed on the one end of the valve shaft 8 is integrally molded on the cover 10.

The cover 40 is attached on the external wall section 12 so that it covers the upper surface 12*a* of the external wall section 12 of the body 1, in order to protect throttle valve mechanism comprising the valve shaft 8, the deceleration gear mechanism 4, the DC motor 3, and the like. The DC motor 3 and the deceleration gear mechanism (power transmission unit) 4 are arranged so that they are protected by the cover 40 as one piece. As shown in FIG. 4, an opening (opening for inserting the motor) of the motor housing section 31 is formed on the external wall section 12, and as shown in FIG. 1, an end bracket 3*a* of the DC motor 3 is fixed around this opening via a screw 88.

A motor terminal 33 of the DC motor 3 is provided on this end bracket 3*a* near to the motor shaft 32. Two terminals are arranged adjacent to one side of the rim (frame) 30 formed on the upper surface 12*a* of the external wall section, in such a manner as facing upwardly, that is, facing to the cover 40 side. The motor 3 is driven by pulse signals in accordance with an accelerator signal relating to a depression amount of the acceleration pedal and a traction control signal, and the driving power from the DC motor 3 is transmitted to the valve shaft 8 via the gears 5, 6*a*, 6*b*, and 9.

The fan-like gear 9 is fixed on the valve shaft 8, and it is engaged with the lever 24 in such a manner as attracting each other via the spring 25, the lever 24 rotatably putting on the valve shaft 8. Consequently, the lever 24 is capable of rotating with the valve shaft 8 up to about 90 degrees. The spring 23 is a return spring of the throttle valve 2, and one end is locked on the spring lock part 85 provided on the body 1, and the other free end is locked on the lever 24.

The springs 23, 25 and the lever 24 constitute a default opening setting mechanism that is well known. The default opening setting mechanism holds an initial opening of the throttle valve 2 which opens more than a full closed position, at the time of engine key off (at the time when the DC motor 3 is stopped). From the default opening position to a full-throttle (full opening) control position, the throttle vale opening is determined based on a balance between the driving power from the DC motor 3 and the force of the spring (return spring) 23. When the throttle valve opening is controlled less than the default opening, movement of the lever 24 is restricted by the default opening stopper (not illustrated), and only the gear 9 and the valve shaft 8 can turns up to the full closed position against the force from the spring 25. A stopper 86 is provided for defining the full closed position, and the full closed position is determined when one side of the fan-like gear 9 comes into contact with the stopper.

The cover 40 is formed in substantially rectangular shape in plan view, similar to an outline of the external wall section 12. In the same manner as the external wall section 12, one edge is notched in "dogleg shape". A flange 41 is formed on all over the periphery of the cover 40. As shown in FIG. 10, on the inner surface of the cover 40, there are formed a sensor housing 40A for taking in the valve position sensor 7, a module housing 40B for taking in the electronic control module 11, and a intermediate connector 42 for connecting with the motor terminal 33 of the DC motor 3. Furthermore, on the outer surface of the cover 40, a connector 43 for the electronic control module 11 is formed to connect with an external unit.

The both housings section 40A and 40B and the intermediate connector 42 are adjacently arranged allowing for compact storage inside the cover 40. The sensor housing 40A is arranged on one side and the intermediate connector 42 is arranged on the other side, placing the module housing 40B therebetween.

The cover 40 is integrally molded with insulating material such as synthetic resin.

Electric wires (conductors) 44 are buried by molding in the cover 40, to connect between the connector 43 for external connection and the electronic control module 11, and between the electronic control module 11 and the intermediate connector 42.

Two inductances 45*a* and 45*b* are installed adjacent to each other in parallel in an inductance installation section 40C lo which is formed at a part of an inner surface of the cover 40. The inductance installation section 40C is provided in the vicinity of the module housing 40B. As shown in FIG. 12, the both ends of the inductances 45*a*, 45*b* are held by holders 44*a* which are formed by allowing each one end of the conductors 44 to protrude and expose on inner surface of the cover 40.

A groove is formed on the top of each holder 44*a*. After the both ends of each inductance 45 are put in the groove, the holder is pressed, thus the inductance is firmly secured.

FIG. 10 shows an expanded illustration of the inductances 45*a* and 45*b* which are a main point of the present invention, and the conductors 44 buried in the cover 40 are denoted with solid lines for easy view.

Furthermore, a plurality of lead frames 50 are buried and orderly arranged on the cover 40, so as to realize connection with a plurality of terminals 51 on a substrate mounting the electronic control module 11. Ends in one side of the lead frames 50 are exposed at a position adjacent to one side of the module housing 40B on the inner surface of the cover 40, and the other ends form connector pins 43*a* of the connector 43 for external connection as shown in FIG. 3. The multiple lead frames 50 and the substrate terminals 51 are connected via a wire bonding 18. The one ends of the lead frames 50 are orderly arranged in a row on inner surface of cover 40, the other ends forming connector pins 43*a* are arranged in zigzag in two rows.

The connector 43 for external connection is connected to a cable connector on the engine control unit (not illustrated) side, and connector pins 43*a* configure various input terminals and output terminals. For example, as the input terminals, there are terminals for a battery power supply and for inputting output signals from the engine control unit (communication signal, cruise control signal, vehicle velocity signal, acceleration pedal signal, and the like). And as the output terminals, there are signals for a throttle valve opening signal, a communication signal from the electronic control module 11 to the engine control unit, and the like. Two of the connector pins 43*a* serve as power supply terminals to drive the DC motor 3.

As shown in FIG. 11, a seal rubber 52 is attached by insertion in a seal groove 46, which is formed by the side walls 48 and 49 on the cover 40 configured as described above. In addition, the valve position sensor 9 is put in the sensor housing 40A, and the electronic control module 11 is taken in the module housing 40B. An aluminum plate 53 for radiating heat is adhered to the module housing 40B of the cover 40, and the electronic control module 11 is adhered to the aluminum plate 53 in the module housing 40B. FIG. 9 shows the inner surface of the cover 40 when the valve position sensor 7 and the electronic control module 11 are placed in the cover 40.

The top of the module housing 40B is covered with a module cover 54. The module cover 54 is installed by adhesive joining on the side wall of the cover 40 which forms the module housing 40B. A circular projection 54*a* is formed integrally on the module cover 54 by molding, and it prevents the gears 6*a*, 6*b* from coming out from the gear shaft 34 in the axial direction. The circular projection 54*a* is provided on a surface opposite to the adhered position of a module cover 54 on inner surface of the cover 40. FIG. 6 and FIG. 7 show the inner surface of the cover 40, when the module cover 54 is installed on the cover 40.

The intermediate connector 42 is integrally molded with the cover 40 on the inner surface of the side wall 49 of the cover 40. Motor connection terminals 15 as shown in FIG. 4 are arranged by insertion into two insertion holes 42*a* as shown in FIG. 8 and FIG. 9. The intermediate connector 42 has two motor connection terminals 15. One end of each terminal 15 is positioned in the upper side of the insertion hole 42*a*, and when the cover 40 is attached on the throttle body 1 (external wall section 12), the terminal 15 is connected to the motor terminal 33 through a metal joint 16 such as a metal sleeve (see FIG. 4, FIG. 11) which is inserted into the insertion hole 42*a*.

As shown in FIG. 8 and FIG. 9, the other ends 15*a* of the two terminals 15 are bent towards left and right sides of the intermediate connector 42, and exposed in the inner surface of the cover 40. The other ends (exposed end portions) 15*a* of the terminal 15 are connected through the wire bonding 18 with the electric wires (conductors) 44 which are connected to the other ends of the inductances 45*a* and 45*b*. The other ends of the inductances 45*a* and 45*b* are connected to the motor terminals 33 of the motor side, i.e., the DC motor 3, through the conductors 44. Therefore, each inductance 45 is connected to both pole sides (plus side and minus side) of an armature of the DC motor 3. It is to be noted that the connection between the terminal 15 and the electric wire conductor 44 can be realized directly by extending at least one of those two elements in overlapped manner.

The electric wire conductor 44 connected to one end of the inductance 45*a*, which is installed adjacently on the inner surface of the cover 40, is also connected to the motor drive terminal 17*a* of the electronic control module 11 through the wire bonding 18. Furthermore, the electric wire conductor 44 connected to one end of the inductance 45*b* is also connected to the motor drive terminal 17*b* of the electronic control module 11 via through the wire bonding 18. The inductances 45*a* and 45*b* constitute a noise eliminator and one ends of them are connected to the motor drive terminals 17*a* and 17*b* of the electronic control module 11 through the electric wire conductor 44.

The motor drive terminals 17*a* and 17*b* of the electronic control module 11 are output terminals of the H-bridge circuit which arranges switching elements in H-shape. Therefore, the DC motor 3 is driven by pulse signals.

FIG. 8 and FIG. 9 show the inner surface of the cover 40, when the valve position sensor (throttle position sensor) 7 and the electronic control module 11 are housed in the cover 40. The valve position sensor 7 and the electronic control module 11 are installed on the cover 40 being adjacent to each other. A plurality of terminals 19 of the valve position sensor 7 are facing to one edge of the electronic control module 11, and connected with a plurality of terminals 20 of the electronic control module (substrate) 11, through the wire bonding 18. The resistor of the valve position sensor 7 is configured by adhering two sheets of strip-shaped conductive films onto an insulating film, having a double system construction, in which two pairs of brushes slidably move on the two sheets of conductive films, respectively. A plurality of terminals 19 are a double system gland terminal, input terminal and output terminal.

Inside the four corners of the flange 41 of the cover 40, holes 55 for cover attachment are drilled, and those holes are aligned with holes 27 of the throttle body 1 and screwed as shown in FIG. 3.

As described above, an electronic control module 11 is installed on the inner surface of the cover 40, further the connector 43 for external connection is provided on the outer surface of the cover 40, and a group of lead frames 50 constituting the terminal of the connector are molded and buried. In addition, ends in one side of the group of the lead frames 50 are orderly arranged along one edge inside the cover 40. It is possible to connect the group of lead frames 50 with a group of terminals 51 of a print circuit board mounting the electronic control module 11, without spreading the group of lead frames 50 within the cover 40.

Power supplying from the DC motor 3 is carried out through the connector 43 for external connection, the electronic control module 11, the inductance 45 installed on the cover 40, and the intermediate connector 42 provided on the cover 40. Therefore, it is not necessary for the lead frames of the power supply to spread in the cover 40, and electric wiring can be rationalized (reduction of wiring and facilitation of connection works can be achieved).

The valve position sensor 7 is a packaged unit type, and assembled in advance as one assembly as shown in FIG. 13 prior to be built-in the cover 40. The valve position sensor has an insertion hole 72 drilled at a substantially central position of the package unit to insert and guide one end of the valve shaft 8. In order to enhance alignment precision with respect to the valve shaft 8, at least two attachment holes 73 for alignment are drilled on the valve position sensor 7. On the other hand, as shown in FIG. 10, the sensor housing 40A of the cover 40 is provided with two attachment pins 57 for alignment, which fit into the attachment holes 73. The pins 57 for alignment are molded with resin, being integral with the cover 40, and as shown in FIG. 9, after fitting to the attachment holes 73, they are thermally welded. The valve position sensor 7 is attached on the cover 40 by heat pressing of the pins 5.

As shown in FIG. 4, in the valve position sensor 7, a potentiometer 78 made of the aforementioned conductive film is doubly formed on the inner surface of the side wall 71 of the package, which is formed by combining a lower case 76 with a package cover 77. A brush (rotor) 79 contacting the potentiometer 78 is built in the package. An elastic piece 80 to receive the valve shaft 8 is disposed at the center of the rotor 79. A circular spring 81 is fitted into the outer circumference of the elastic piece 80.

When the cover 40 is attached on the throttle body 1, the upper end of the valve shaft 8 is inserted into the hole 72 while the elastic piece 80 deforms elastically by pushing of the insertion. The rotor 79 goes into engagement with the valve shaft 8 without rattling by a fastening force from the circular spring 81.

As shown in FIG. 10, on the inner surface of the cover 40, a partitioning wall 58 is formed so as to partition an area for the module housing 40B including an inductance installation area (section) 40C and for the sensor housing 40A. The partitioning wall 58 is provided with a notch 59 in a shape of inverted trapezium. One end on the terminal side (terminal block) 74 of the valve position sensor 7 (see FIG. 9 and FIG. 13) fits into this notch. When the valve position sensor 7 is installed on the sensor housing 40A, the terminal block 74 fits into the notch 59, keeping airtight status. The electronic control module 11 and the inductances 45*a*, 45*b* are covered with gel, so as to be protected from moisture, and with the airtight attachment between the partitioning wall 58 and the terminal block 74, it is possible to prevent outward flow of gel.

The partitioning wall 58 at the notch 59 is protruding to some extent. On the other hand, as shown in FIG. 13, the fitting groove 75 is formed on the valve position sensor 7. When the valve position sensor 7 is installed on the sensor housing 40A, the partitioning wall 58 at the notch 59 portion is allowed to fit into the fitting groove 75 in airtight status.

The electronic controlled throttle system according to the present invention is configured as described above. In here the inductance is installed on the inner surface of the cover which is attached on the throttle body in order to protect the DC motor and the power transmission unit disposed on the throttle body, the inductance being connected to the DC motor and the driving power source through the electric wire conductor. Therefore, the DC motor can be downsized and made less expensive, as well as there is no more influence due to the heat of the DC motor, it is possible to enhance reliability and to reduce the radiant noise.

In the above embodiment, since the inductance is installed with the holder members (supporting legs) which are formed by allowing each one end of the electric wire conductors buried to protrude and expose on the inner surface the cover, it is easy to install the inductance on the cover. Further, the end of the holder members by the electric wire conductors serves as a stopper to prevent the inductance from dropping off, and thus it is not necessary to use an expensive adhesive material which is resistant to high temperature circumstance. In other words, it is possible to mount a low-cost inductance.

EXAMPLE 2

Figure 15:
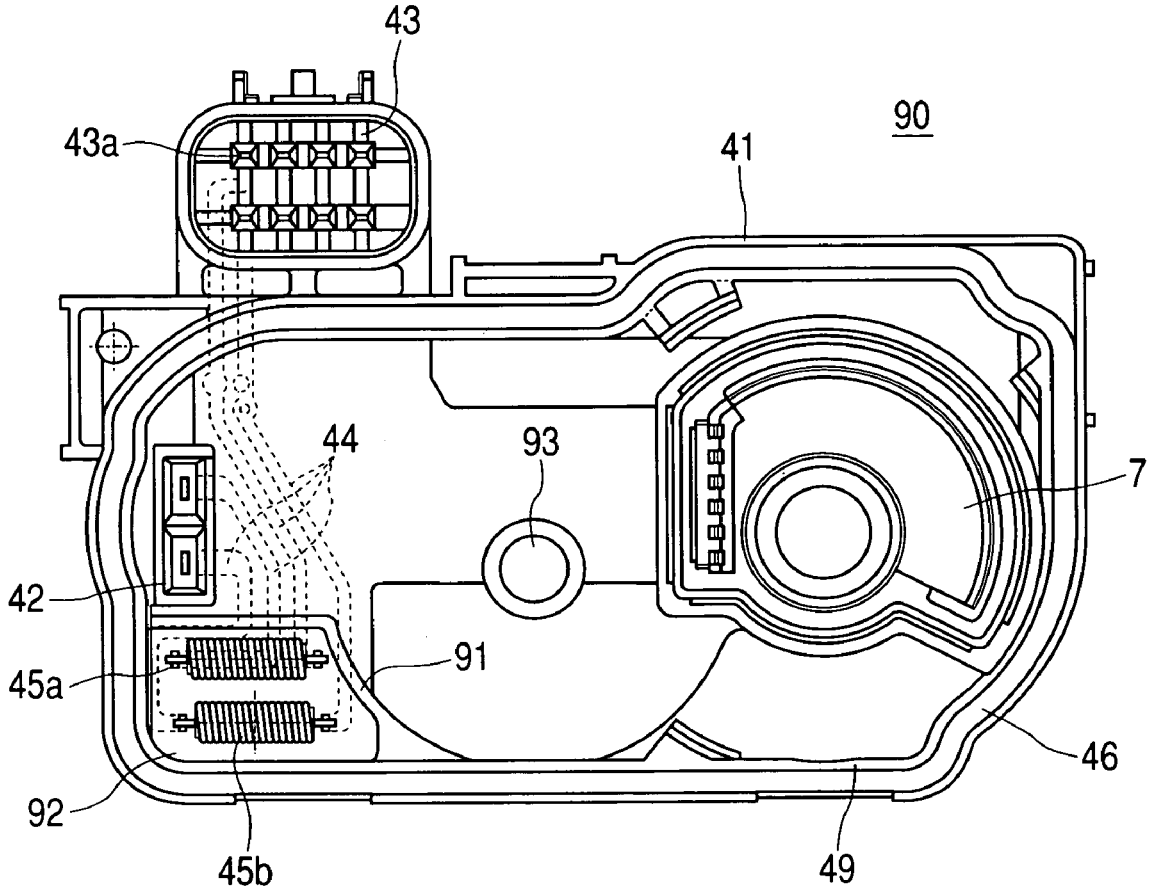
FIG. 15 is a bottom view of the cover showing another embodiment of the present invention.
Figure 16:
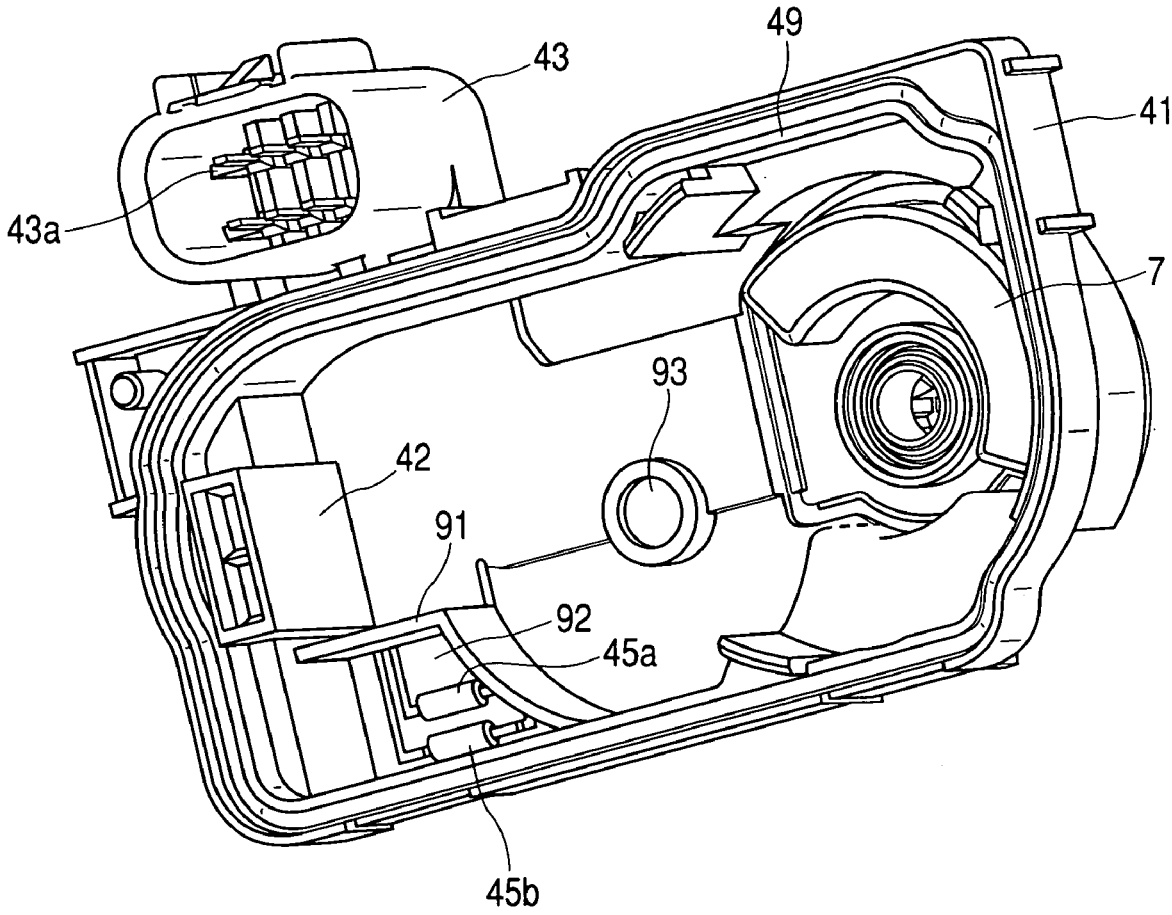
FIG. 16 is a perspective view showing the cover in another embodiment, viewed from the bottom of the cover.

Another embodiment of the present invention is shown in FIG. 15 and FIG. 16. In the example 2, the electronic control module is provided on the engine control unit, and it is not installed on the cover. Here, the throttle body used in this example is the same as that of the example 1.

FIG. 15 shows a bottom view of the cover, and FIG. 16 is a perspective view of the cover viewed from the bottom. In FIG. 15 and FIG. 16, corresponding elements are labeled the same as those in FIG. 1 to FIG. 14.

An inductance housing 92 is formed on the cover 90 by the partitioning wall 91. In the inductance housing 92, the inductances 45*a* and 45*b* are installed on the holder members (supporting legs 44*a*) formed by the electric wire conductors 44, as shown in FIG. 12. The inductance housing 92 is filled with gel so as to protect the inductances 45*a* and 45*b* from moisture.

The electric wire conductors 44 connected to ends on one side of the inductances 45*a* and 45*b* are respectively connected to two connector pins 43*a* of the connectors for external connection 43. The two connector pins 43*a* connected with the electric wire conductors 44, serve as driving power terminals to which a motor driving power source from the electric control module, provided in the engine control unit, is applied. The inductances 45*a* and 45*b* constitute a noise eliminator, and one end thereof is connected to the driving power source terminal of the connector for external connection 43, through the electric wire conductor 44.

The electric wire conductors connected to the other ends of the two inductances 45*a* and 45*b* are connected to the terminal 15 of the intermediate connector 42 (exposed end portion 15A) similar to the example 1. The other ends of the inductances 45*a* and 45*b* are connected to the motor terminal 33, that is, the DC motor 3, through the electric wire conductor 44. Both ends of the armature of the DC motor 3 are connected to the inductance 45.

It is to be noted that on the inner surface of the cover 90, there is formed a circular projection 93 for regulating the gears 6*a* and 6*b* integrally molded not to deviate from the gear shaft 34 into the axial direction.

As described above, also in the example 2, since the inductance for removing a radiant noise is installed on the inner surface of the cover, which is mounted on the throttle body, the DC motor can be downsized and made less expensive, as well as there is no more influence due to the heat of the DC motor, it is possible to enhance a reliability and to reduce the radiant noise.

In the above examples 1 and 2, two inductances are provided but it is matter of course that only one inductance is also applicable.

What is claimed is:

1. An electronically controlled throttle device, comprising:

a throttle body having a throttle valve housing section and a motor housing section which are integrally molded;

a DC motor put in the motor housing section of said throttle body to drive said throttle valve;

a power transmission unit arranged on said throttle body to transmit a driving power from said DC motor to said throttle valve;

a cover attached on said throttle body to protect said DC motor and said power transmission unit; and an inductance installed on an inner surface of said cover and connected with said DC motor and a power supply through conductors.

2. The electronically controlled throttle device according to claim 1, wherein said inductance is covered by gel.

3. The electronically controlled throttle device according to claim 1, wherein each one end of said conductors protrudes near to the inductance on the inner surface of said cover, and such protruding ends of said conductors hold both ends of said inductance.

4. An electronically controlled throttle device, comprising:

a throttle body having a throttle valve housing section and a motor housing section which are integrally molded with an insulating material;

a DC motor put in the motor housing section of said throttle body to drive said throttle valve;

a power transmission unit with gears arranged on said throttle body to transmit a driving power from said DC motor to said throttle valve;

a cover attached on said throttle body to protect said DC motor and said power transmission unit; and an inductance installed on an inner surface of said cover, wherein one end of said inductance is connected with said DC motor through one conductor buried in said cover, and another end thereof is connected with a power supply through another conductor buried in said cover.

5. The electronically controlled throttle device according to claim 4, wherein each one end of said conductors protrudes near to the inductance on the inner surface of said cover, and such protruding ends of said conductors hold both ends of said inductance.

6. The electronically controlled throttle device according to claim 4, wherein said inductance is covered by gel.

7. An electronically controlled throttle device, comprising:

a throttle body having an external wall section for a gear space, a throttle valve housing section and a motor housing section which are integrally molded with an insulating material;

a DC motor put in the motor housing of said throttle body to drive said throttle valve and controlled by electrical throttle devices;

a power transmission unit configured with gears which are arranged on said external wall section of said throttle body to transmit a driving power from said DC motor to said throttle valve;

a cover attached on said external wall section of said throttle body so as to cover said DC motor and said power transmission unit;

a connector provided on an outer surface of said cover to electrically connect with an external unit and having a plurality of terminals including a power supply terminal for said DC motor; and an inductance installed on an inner surface of said cover, wherein one end of said inductance is connected with said power supply terminal through one conductor buried in said cover, and another end thereof is connected with said DC motor through another conductor buried in said cover.

8. The electronically controlled throttle device according to claim 7, wherein each one end of said conductors protrudes near to the inductance on the inner surface of said cover, and such protruding ends of said conductors hold both ends of said inductance.

9. The electronically controlled throttle device according to claim 7, wherein said inductance is covered by gel.

10. An electronically controlled throttle device, comprising:

a throttle body having an external wall section for a gear space, a throttle valve housing section and a motor housing section which are integrally molded with an insulating material;

a DC motor put in the motor housing of said throttle body to drive said throttle valve and controlled by electrical throttle devices;

a power transmission unit configured with gears which are arranged on said external wall section of said throttle body to transmit a driving power from said DC motor to said throttle valve;

a cover attached on an external wall section of said throttle body so as to cover said DC motor and said power transmission unit;

a connector provided on an outer surface of said cover to electrically connect with an external unit and having a plurality of terminals including a power supply terminal for said DC motor;

an intermediate connector with a joint member connected to said power supply terminal through a conductor buried in said cover, and connected to a terminal of said DC motor through said joint member when said cover is attached on said external wall section of said throttle body; and an inductance installed on an inner surface of said cover, wherein one end of said inductance is connected with said power supply terminal through one conductor buried in said cover, and another end thereof is connected with said intermediate terminal through another conductor buried in said cover.

11. The electronically controlled throttle device according to claim 10, wherein each one end of said conductors protrudes near to the inductance on the inner surface of said cover, and such protruding ends of said conductors hold both ends of said inductance.

12. The electronically controlled throttle device according to claim 10, wherein said inductance is covered by gel.

13. An electronically controlled throttle device, comprising:

a throttle body having an external wall section for a gear space, a throttle valve housing section and a motor housing section which are integrally molded with an insulating material;

a DC motor put in the motor housing of said throttle body to drive said throttle valve and controlled by electrical throttle devices;

a power transmission unit configured with gears which are arranged on said external wall section of said throttle body to transmit a driving power from said DC motor to said throttle valve;

a cover attached on an external wall section of said throttle body so as to cover said DC motor and said power transmission unit;

a connector provided on an outer surface of said cover to electrically connect with an external unit and having a plurality of terminals including two power supply terminals for said DC motor;

an intermediate connector with joint members connected to said power supply terminals through conductors buried in said cover, and connected to terminals of said DC motor side through said joint members when said cover is attached on said external wall section of said throttle body;

an inductance housing formed by providing a partitioning plate on an inner surface of said cover; and a noise eliminator configured with two inductances placed in said inductance housing, wherein one end of each inductance is connected with each power supply terminal through conductor buried in said cover, and another end thereof is connected with each terminal of said intermediate connector through said conductor.

14. The electronically controlled throttle device according to claim 13, wherein each one end of said conductors protrudes near to the inductance on the inner surface of said cover, and such protruding ends of said conductors hold both ends of said inductance.

15. The electronically controlled throttle device according to claim 13, wherein said inductance is covered by gel.

16. An electronically controlled throttle device, comprising:

a throttle body having an external wall section for a gear space, a throttle valve housing section and a motor housing section which are integrally molded with an insulating material;

a DC motor put in the motor housing of said throttle body to drive said throttle valve and controlled by electrical throttle devices;

a power transmission unit configured with gears which are arranged on said external wall section of said throttle body to transmit a driving power from said DC motor to said throttle valve;

a cover attached on said external wall section of said throttle body so as to cover said DC motor and said power transmission unit;

a connector provided on an outer surface of said cover to electrically connect with an external unit and having a plurality of terminals including a power supply terminal for said DC motor;

an electronic control module placed in a module housing section provided at said cover to control said throttle valve, and to which DC voltage is supplied from said power supply terminal of said connector; and an inductance installed on an inner surface of said cover, wherein one end of said inductance is connected with each motor driving terminal of said electronic control module through one conductor buried in said cover, and another end thereof is connected with said DC motor through another conductor.

17. The electronically controlled throttle device according to claim 16, wherein said electronic control module and said inductance are covered by gel.

18. The electronically controlled throttle device according to claim 17, wherein each one end of said conductors protrudes near to the inductance on the inner surface of said cover, and such protruding ends of said conductors hold both ends of said inductance.

19. The electronically controlled throttle device according to claim 16, wherein each one end of said conductors protrudes near to the inductance on the inner surface of said cover, and such protruding ends of said conductors hold both ends of said inductance.

20. An electronically controlled throttle device, comprising:

a throttle body having an external wall section for a gear space, a throttle valve housing section and a motor housing section which are integrally molded with an insulating material;

a DC motor put in the motor housing of said throttle body to drive said throttle valve and controlled by electrical throttle devices;

a power transmission unit configured with gears which are arranged on said external wall section of said throttle body to transmit a driving power from said DC motor to said throttle valve;

a cover attached on said external wall section of said throttle body so as to cover said DC motor and said power transmission unit;

a connector provided on an outer surface of said cover to electrically connect with an external unit and having a plurality of terminals including a power supply terminal for said DC motor;

an electronic control module placed in a module housing section provided at said cover to control said throttle valve, and to which DC voltage is supplied from said power supply terminal of said connector;

an intermediate connector with joint members connected to terminals of said DC motor side when said cover is attached on said external wall section of said throttle body;

an inductance installed near to said electronic control module on an inner surface of said cover, wherein one end of said inductance is connected with a motor driving terminal provided at said electronic control module through one conductor buried in said cover, and another end thereof is connected with said intermediate connector through said another conductor buried in said cover.

21. The electronically controlled throttle device according to claim 20, wherein said electronic control module and said inductance are covered by gel.

22. The electronically controlled throttle device according to claim 20, wherein each one end of said conductors protrudes near to the inductance on the inner surface of said cover, and such protruding ends of said conductors hold both ends of said inductance.

23. An electronically controlled throttle device, comprising:

a throttle body having an external wall section for a gear space, a throttle valve housing section and a motor housing section which are integrally molded with an insulating material;

a DC motor put in the motor housing of said throttle body to drive said throttle valve;

a power transmission unit configured with gears which are arranged on said external wall section of said throttle body to transmit a driving power from said DC motor to said throttle valve;

a cover attached on said external wall section of said throttle body so as to cover said DC motor and said power transmission unit;

a connector provided on an outer surface of said cover to electrically connect with an external unit and having a plurality of terminals including two power supply terminals for said DC motor;

an electronic control module placed in a module housing section provided at said cover to control said throttle valve, and to which DC voltage is supplied from said power supply terminals of said connector, and having two motor driving terminals, an intermediate connector with joint members provided on inner surface of said cover , and having two terminals connected to terminals of DC motor side through said joint member when said cover is attached on said external wall section of said throttle body;

a noise eliminator configured with two inductances placed in parallel near to said module housing section on inner surface of said cover, wherein one end of each inductance is connected with each motor driving terminal of said electronic control module through one conductor buried in said cover, and another end thereof is connected with each terminal of said intermediate connector through another conductor buried in said cover.

24. The electronically controlled throttle device according to claim 23, wherein said electronic control module and said inductance are covered by gel.

25. The electronically controlled throttle device according to claim 23, wherein each one end of said conductors protrudes near to the inductance on the inner surface of said cover, and such protruding ends of said conductors hold both ends of said inductance.

* * * * *